US010967245B2

(12) United States Patent
Potter

(10) Patent No.: US 10,967,245 B2
(45) Date of Patent: Apr. 6, 2021

(54) TRACKED SKATE RUNNER

(71) Applicant: Steven Dickinson Potter, Bedford, MA (US)

(72) Inventor: Steven Dickinson Potter, Bedford, MA (US)

( * ) Notice: Subject to any disclaimer, the term of this patent is extended or adjusted under 35 U.S.C. 154(b) by 317 days.

(21) Appl. No.: 16/055,127

(22) Filed: Aug. 5, 2018

(65) Prior Publication Data

US 2020/0038737 A1 Feb. 6, 2020

(51) Int. Cl.

| | |
|---|---|
| ***A63C 17/10*** | (2006.01) |
| ***A63C 17/06*** | (2006.01) |
| ***A63C 5/035*** | (2006.01) |
| ***A63C 17/00*** | (2006.01) |
| *A63C 17/04* | (2006.01) |

(52) U.S. Cl.

CPC ..... *A63C 17/10* (2013.01); *A63C 5/035* (2013.01); *A63C 17/0046* (2013.01); *A63C 17/06* (2013.01); *A63C 17/045* (2013.01)

(58) Field of Classification Search

CPC ..... A63C 17/0046; A63C 17/06; A63C 17/10; A63C 17/045; A63C 5/035; B62D 55/02; B62D 55/14; B62D 55/22

See application file for complete search history.

(56) References Cited

U.S. PATENT DOCUMENTS

| | | | | |
|---|---|---|---|---|
| 342,457 | A * | 5/1886 | Peirce | A63C 17/10 280/844 |
| 342,458 | A | 5/1886 | Peirce | |
| 351,749 | A | 11/1886 | Dinsmoor | |
| 675,824 | A | 6/1901 | Fohr | |
| 889,946 | A | 6/1908 | Miller | |
| 1,111,583 | A | 9/1914 | Holt | |
| 1,508,218 | A | 9/1924 | Chevreau | |
| 1,583,114 | A | 5/1926 | Bierly | |
| 1,694,162 | A | 7/1926 | Buitenkamp | |
| 1,868,148 | A | 7/1932 | McMillan | |

(Continued)

FOREIGN PATENT DOCUMENTS

| | | | | |
|---|---|---|---|---|
| DE | 2328987 | A1 * | 1/1975 | A63C 17/045 |
| DE | 29713564 | U1 * | 10/1997 | A63C 17/18 |

(Continued)

OTHER PUBLICATIONS

Bennett, Jay; "Electric Off-Road Rollerblades Let You Skate Anywhere You Want," Popular Mechanics, May 28, 2016; https://www.popularmechanics.com/technology/a20141/electric-off-road-rollerblades-let-you-go-anywhere/ (Year: 2016).*

(Continued)

*Primary Examiner* — Steve Clemmons

(74) *Attorney, Agent, or Firm* — Leber IP Law; Celia H. Leber

(57) ABSTRACT

A tracked skate runner provides a low-profile substitute for a wheel with exceptionally low rolling resistance on rough or soft terrain. The runner includes a skate frame and rollers that bear against an endless track of hinged links devoid of pinch points that can get jammed with ground debris. The skate frame provides a channel with sidewalls and a top dirt shield. The sidewalls fit closely with the links of the track to seal out dirt, and the top dirt shield protects the rollers from dirt that shakes off the top recirculating portion of the track.

27 Claims, 6 Drawing Sheets

(56) References Cited

U.S. PATENT DOCUMENTS

| | | | | | |
|---|---|---|---|---|---|
| 2,412,290 | A | | 12/1946 | Rieske | |
| 4,531,787 | A | | 6/1985 | Hart | |
| 4,572,528 | A | | 2/1986 | McBride | |
| 5,580,096 | A | * | 12/1996 | Freilich | A63C 17/10 280/844 |
| 7,976,064 | B2 | | 7/2011 | Abdulaev | |
| 8,297,656 | B2 | | 10/2012 | Arbogast | |
| 2007/0029878 | A1 | * | 2/2007 | Gaudreault | B62D 55/0842 305/130 |
| 2015/0336624 | A1 | * | 11/2015 | Sun | B62D 55/20 305/138 |
| 2017/0166271 | A1 | * | 6/2017 | Hakes | B62D 55/14 |
| 2017/0327162 | A1 | * | 11/2017 | Ellmann | E02F 9/02 |

FOREIGN PATENT DOCUMENTS

| | | | | | |
|---|---|---|---|---|---|
| DE | 29717269 | U1 | * | 11/1997 | A63C 17/10 |
| DE | 29906506 | U1 | * | 12/1999 | A63C 17/10 |
| FR | 2428451 | A3 | * | 1/1980 | A63C 17/10 |
| GB | 1312507 | A | * | 4/1973 | A63C 17/10 |
| GB | 1559304 | A | * | 1/1980 | A63C 17/16 |
| WO | WO-2006038897 | A1 | * | 4/2006 | A63C 17/10 |

OTHER PUBLICATIONS

"Chariot Skates", www.chariotskates.com, published online at least as early as 2009, 1 page.
"Rollerblade Coyote", www.rollerblade.com/3wd/, published online at least as early as 2016,1 page.

* cited by examiner

Section B-B

Section C-C

Section A-A
of Fig. 1

Fig. 11
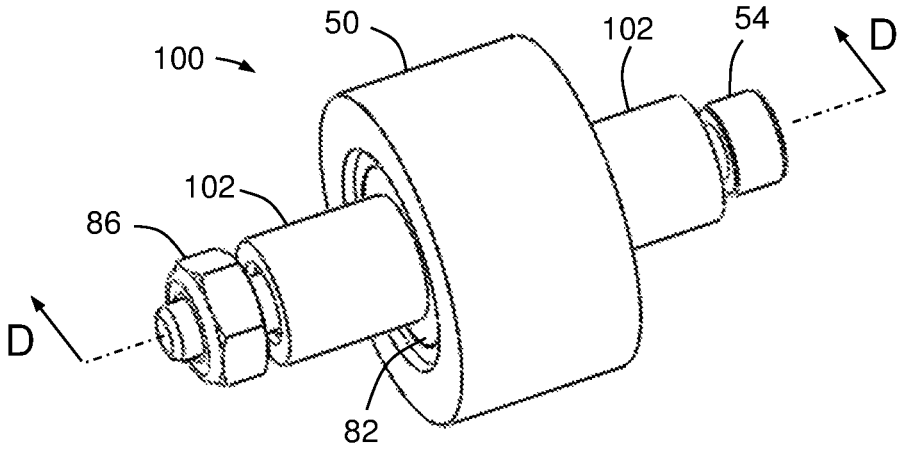
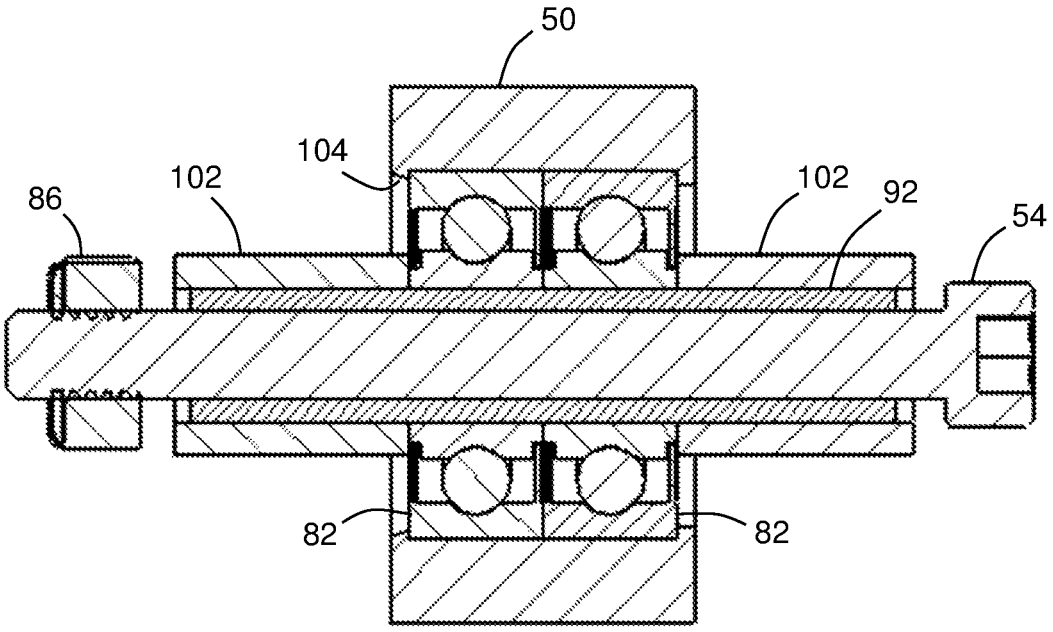
Fig. 12
Section D-D

Section E-E

TRACKED SKATE RUNNER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention relates to low-profile endless track mechanisms for the purpose of gliding over rough or soft ground. It especially relates to the use of such mechanisms to ski or skate without the need for snow or ice.

For a mountain bike to roll over obstacles such as rocks, roots and small branches, as encountered on a typical trail, the minimum wheel diameter is approximately 2 feet. Mounting one such wheel per leg has been tried, e.g. the "Chariot Wheel", but leads to poor fore-aft stability and usually requires a second smaller wheel. Wheels up to about 8" diameter have been mounted under a skate boot, e.g. the "Rollerblade Coyote", but the small diameter rolls poorly over obstacles, and the high ground contact pressure leads to poor rolling resistance on soft ground. Larger wheels under the boot result in excessive lateral torque on the knee, and large wheels fore and aft of the boot cause excessive weight and poor ground clearance.

Compared with wheels, the use of endless belts or tracks allows much larger contact area and lower ground pressure. This translates to less work done to indent the ground, and the potential for lower rolling resistance. Tracks can also provide a more gently curved or ramped bottom surface to roll over obstacles more smoothly.

The patent literature includes many examples of tracked vehicles as used on heavy machinery, snowmobiles, military vehicles (tanks). There are relatively fewer examples of tracked skates and grass-skis.

The skate/ski prior art falls into four main groups: 1) belts or tracks sliding on an oval track (e.g. Pierce U.S. Pat. No. 342,458, 1886), 2) belts or tracks rolling on an oval track using recirculating balls or rollers (e.g. Fohr U.S. Pat. No. 675,824A, 1901, Chevreau, U.S. Pat. No. 1,508,218, 1924, Abdulaev, U.S. Pat. No. 7,976,064B2, 2011), 3) belts or tracks with attached rollers engaging an oval or indented oval track (e.g. the Rollka grass skis), 4) belts or tracks suspended by rollers (e.g. Bierly, U.S. Pat. No. 1,583,114, 1926, and Rieske, U.S. Pat. No. 2,412,290, 1946), and 5) non-inverting belts or tracks suspended by rollers (e.g. Miller, U.S. Pat. No. 889,946, 1908 and Freilich, U.S. Pat. No. 5,580,096, 1996).

The first group tends to have very high friction due to the sliding interface.

The second group typically uses a continuous belt and small closely spaced rollers or balls. The belt needs to be quite thin and soft to be able to make the small radius turn at either end of the skate, and this runs counter to the need for bending stiffness to spread the load on the ground and to have low rolling resistance against the balls or rollers. This group is very sensitive to dirt fouling the mechanism due to the small size of the rolling elements, and their close proximity to the ground. Putting full weight on a small obstacle like a root or rock is likely to damage the rolling interface.

The third category includes the most successful type of grass-ski, first manufactured by Rollka. This device has acceptably low friction for downhill skiing but not for cross-country. It is inherently fragile for its weight and requires a soft ground surface, i.e. grass. The widely-spaced roller assemblies result in high local ground pressure, with sections of unsupported belt. Going over a branch or root can indent the belt and cause excessive tension that damages the track/roller mechanism.

The fourth category is the standard for modern ground-moving machinery, snow-cat's, snowmobiles and tanks. In the skate examples given (Bierly and Rieske), the rollers are large and widely spaced, and the resultant ground contact pressure is not much different than if the track were not there. Use of a stiffer belt or very high belt tension is not practical due to excessive friction and hysteresis. Use of small, closely spaced rollers and hinged links (e.g. Miller), is advantageous, but there is a typically a weak point at either end of the track due to the need for large end-rollers.

The fifth category has hinged links that can bend around the end-rollers, but resist being bent in the opposite direction. This allows the track to maintain its shape even when the rollers are large and widely spaced, but at the expense of very high tensile loads in the hinge joints. As described by Miller and Freilich, the hinge-stop mechanisms represent pinch-points for dirt and gravel. This causes extreme loads on the hinges leading to premature failure.

There remains a need for a low-profile, lightweight skate runner with very low rolling resistance that can handle terrain with roots, rocks, and soft ground, is reasonably safe, does not get fouled by dirt and detritus, and can be manufactured cheaply.

SUMMARY OF THE INVENTION

The present invention is a tracked skate runner appropriate for mounting to a skate boot as well as other uses. It has a roller assembly with a skate frame and rollers which bear against an endless track of hinged links. The frame provides a channel with sidewalls to shield out dirt, and a top shield to protect the rollers from dirt which shakes loose from the top recirculating portion of the track. The track is substantially devoid of pinch-points that can get jammed with ground debris and cause a kink in the bottom load-bearing portion of the track.

In various preferred embodiments, the following features may be included in various combinations: The skate frame may be a structural channel made from an aluminum extrusion or bent sheet metal. The links may have flanges defining a guide channel for the rollers, and the rollers may extend below the sidewalls as a safety feature in case the track breaks. The end-rollers may be spool-shaped and overlap the adjacent rollers to shorten the span and better support the track. The links may have knuckles which mate to form hinges that provide a smooth interdigitated rolling surface for the rollers. The hinges may have internal hinge-stops to prevent reverse bending without presenting external pinch-points. These stops may employ bumps on knuckles engaging webs between knuckles and visa-versa to form a strong "handshake". The rolling surfaces of the rollers and links may be made of hard materials to provide low rolling resistance, and the ground-contacting sides of the links may have elastomeric treads to protect the hinges and provide a smooth ride. The treads may be chamfered to avoid pinching ground debris. The skate frame may have brackets to connect to a boot, and the dimensions of the tracked skate runner may be tuned for the skate application. The bottom portion of the track may be rockered 0.15 to 0.6 inches, the pitch of the track may be 0.5 to 1.2 inches, the end-rollers may be sized such that the angle between links is 120-144° (equivalent to a 6-10 sided polygon), the width of the links may be 0.7-2 inches, and the thickness of the treads may be 0.1-0.5 inch.

Using the above features and dimensions can minimize stresses on the links which enables the use of polymer rollers and link-bodies which can be manufactured cheaply by injection molding, casting or 3D printing.

BRIEF DESCRIPTION OF THE DRAWINGS

FIG. 11 shows a perspective view of a narrow mid-roller assembly.

FIG. 12 shows a cross-section D-D of FIG. 11.

DETAILED DESCRIPTION OF THE INVENTION

Figure 1:
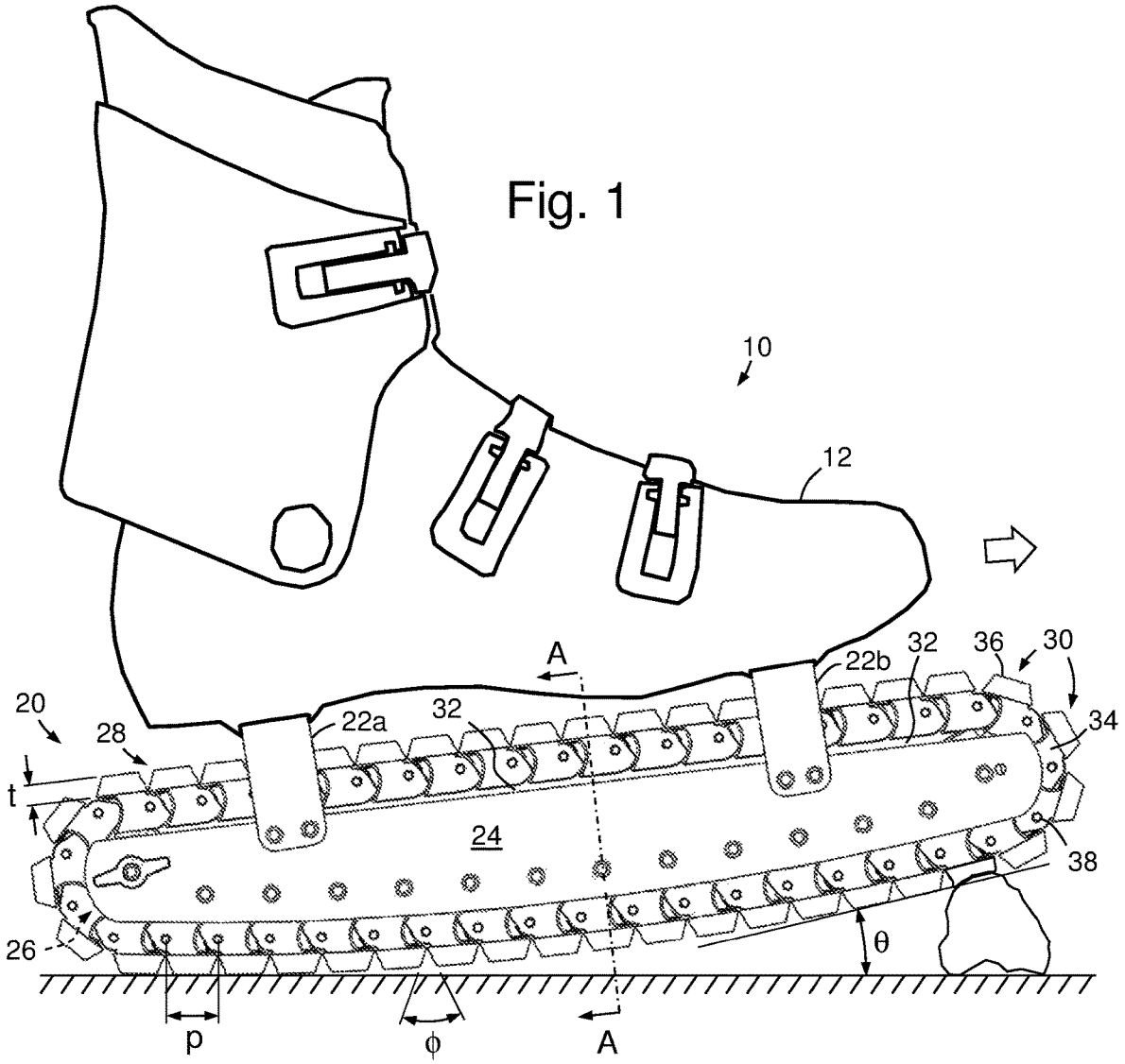
FIG. 1 shows a side view of a tracked skate engaging a ground obstacle.

FIG. 1 shows tracked skate runner 20 mounted to skate boot 12, resulting in tracked skate 10. The tracked skate runner comprises roller assembly 26 and endless track 28. The roller assembly includes skate frame 24, which supports rollers (not visible) and has mounting brackets 22*a* and 22*b*. The endless track is comprised of hinged links 30 joined by hinge pins 38. Each link has a link-body 34 and tread 36. The distance between hinge centers is defined as the track pitch "p" which for the skate application is preferably between 0.5 and 1.2 inches.

For the skate application, the preferred thickness "t" of the treads is 0.1 to 0.5 inch, with 0.3 inch being especially preferred. The treads are preferably chamfered or rounded to avoid pinching debris at the bottom/front of the skate. This reduces rolling resistance and helps avoid delamination of the treads. The included angle "φ" between treads on the bottom surface of the track should be at least 30°, and is preferably 45°. This largely avoids pinching while maintaining a large tread contact area.

The preferred track pitch is between 0.5 and 1.2 inches, and a pitch of 0.8 inches is especially preferred. Making the pitch too small reduces the surface area of the treads (for a given tread thickness and chamfer), and drives up the parts count which increases cost. Making the pitch too large results in large end-rollers that increase the height of the boot off the ground and cause excessive lateral torque on the knee.

Tracked skate runner 20, FIG. 1, is shown hitting an obstacle such as a rock or root. The roller assembly 26 provides curvature that allows the rear of the track to maintain a large contact area with the ground while still allowing the front of the track sufficient clearance to engage the obstacle at a shallow angle (θ). In this example the radius of curvature is 50 inch, the obstacle is 1.3 inch high and the contact angle θ is 15°. Increasing the radius of curvature (i.e. reducing the rocker) reduces the size of the obstacle that can be overcome. Decreasing the radius of curvature reduces the fore-aft stability of the skate and increases the ground contact pressure resulting in increased rolling resistance, especially on soft ground. A radius of curvature of 50 inches is a good compromise.

The curvature need not be exactly constant, but there are advantages to having a smooth curve. Angles between adjacent links are minimized, presenting a smoother surface for the rollers to roll over. Avoiding large changes in curvature avoids expansion and contraction between treads that would cause rubbing on the ground, and it avoids regions of small curvature that apply excessive ground pressure. The preferred radius of curvature (50 inches) also helps keep the track from sagging down from the roller assembly when the skate runner is lifted off the ground.

Figure 2:
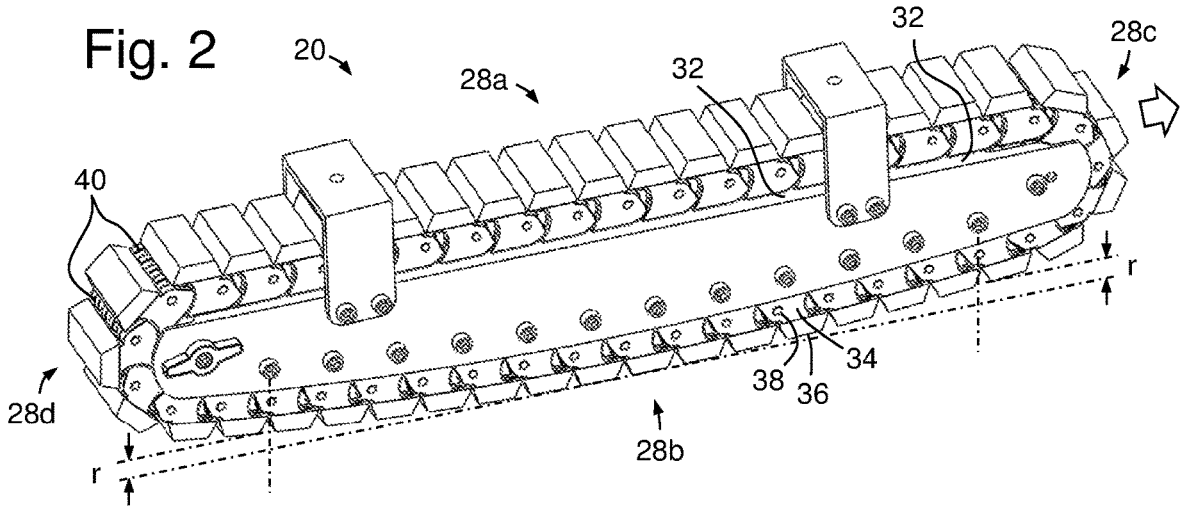
FIG. 2 shows a perspective view of a tracked skate runner.

FIG. 2 shows a perspective view of tracked skate runner 20. Endless track 28 includes top recirculating portion 28*a*, bottom ground-contacting portion 28*b*, front turnaround portion 28*c*, and rear turnaround portion 28*d*. The front and rear portions of the track engage the front and rear end-rollers (not visible). This assembly can be mounted to a boot as in FIG. 1, or could be used for other purposes such as on a wheelbarrow, sled, golf caddy cart, beach cart, skateboard, scooter, bicycle, snowmobile, or aircraft landing gear. For the skate application, the preferred width of the track is between 0.7 and 2 inches. This provides a large ground contact area without excessive weight and allows the skate to "edge" without excessive lateral torque on the knee.

FIG. 2 also shows hinges 40 of the endless track. The hinges are exposed at the front and rear of the skate, but may be close-fitting to minimize intrusion of sand and dirt. On the bottom surface of the track, the hinges may retract into the link bodies, and/or be protected by the treads. While the preferred radius of curvature of the bottom portion of the track is about 50 inches, to establish an acceptable range, a better metric is the "rocker", ("r" in FIG. 2), defined herein as the height clearance of the track measured at the front and rear mid-rollers (50, FIG. 3) when the bottom portion of the track is touching flat ground. The preferred range of r is 0.15 to 0.6 inch, with 0.325 inch being especially preferred.

Figure 3:
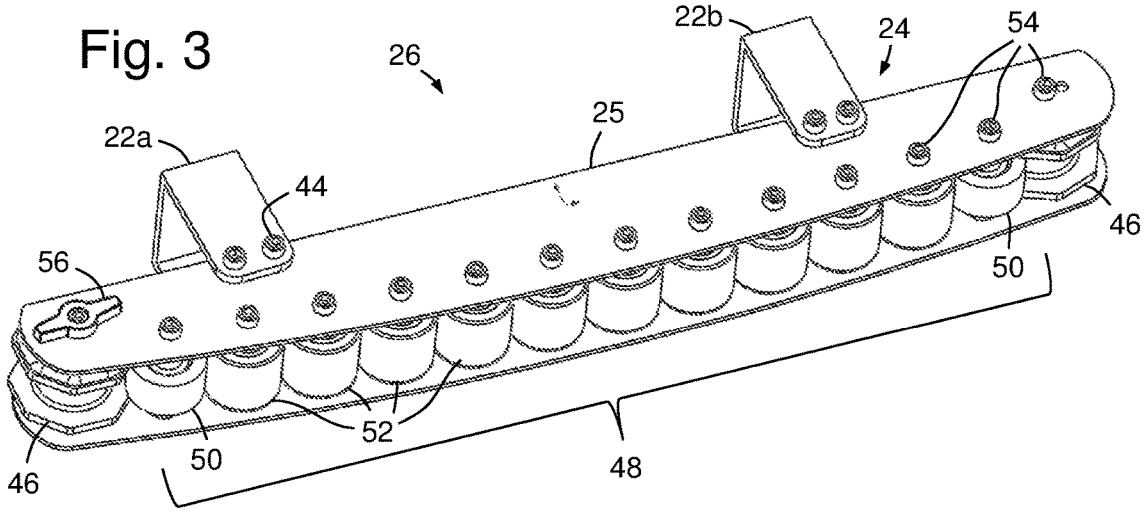
FIG. 3 shows a perspective view of a roller assembly

The FIG. 3 shows example roller assembly 26 in accordance with the invention. Skate frame 24 supports end-rollers 46 and mid-rollers 48 using roller mounting screws 54. The rear end-roller has wing-nut 56 allowing adjustment of the track tension without tools. In this example, the skate frame is assembled from structural channel 25 and mounting brackets 22*a* and 22*b* secured with screws 44. The channel may be made from an aluminum extrusion, or bent from sheet metal. Many other fabrication methods are possible, including injection molding and 3D printing.

The end-rollers are preferably sized such that the links engaging them form an included angle between 120 and 144°. This corresponds to a polygon with 6 to 10 sides. The end-rollers can be round, but polygonal is preferred to increase contact area and reduce wear. For a given track pitch, smaller end-rollers result in greater energy lost to impact as the links engage the rollers. Smaller end-rollers also result in greater noise due to height oscillation of the top section of track. Large end-rollers result in greater height of the roller assembly which leads to excessive lateral torque on the knee. Octagonal end-rollers are a good compromise. These result in an included angle of 135° of the engaging links.

Figure 4:
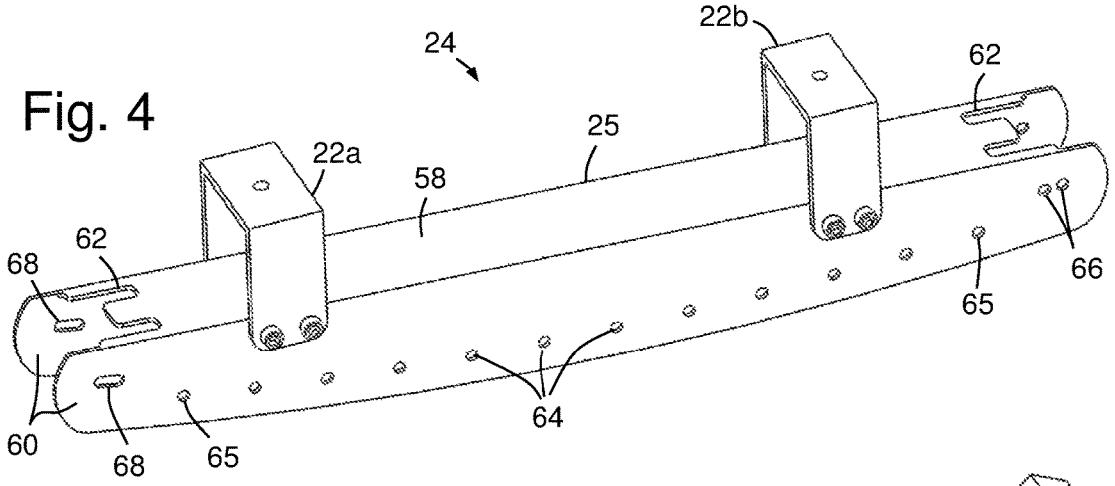
FIG. 4 shows a perspective view of a skate frame.

FIG. 4 shows skate frame 24 with rollers removed. The skate frame has top dirt shield 58 and sidewalls 60 protecting the rollers from dirt and debris. In a preferred embodiment, the dirt shield and the sidewalls are made in one piece, forming a structural channel. The dirt shield has cutouts 62 to accept end-rollers 46, FIG. 3. Holes 64 and 65 are configured to mount mid-rollers 48, FIG. 3. One or more holes 66 are configured to mount the front end-roller 46, Duplicate holes 66 may be used to compensate for variation in track length due to wear of the hinges, fabrication tolerances or thermal expansion. Slots 68 allow for track tension adjustment.

In other embodiments, the channel could be made from an assembly of parts, for instance two side plates separated by standoffs, and the top dirt shield need not be structural.

Referring back to FIG. 2, dirt that gets picked up by the bottom portion 28*b* of the track, or that works its way through hinges 40, will tend to get shaken loose at the top recirculating portion 28*c* of the track and fall off to the sides or land on top dirt shield 58, FIG. 4. Due to a combination of vibration, air currents, and edging of the skate runner, dirt migrates out dirt windows 32, FIGS. 1 & 2. The dirt shield may be flat, angled, domed or otherwise shaped to shed dirt more effectively. The dirt windows may be gaps between the top portion of the track and the dirt shield as in FIGS. 1&2, or, the dirt windows may be openings in the the dirt shield that communicate with chutes or catch basins to collect or shed dirt.

Figure 5:
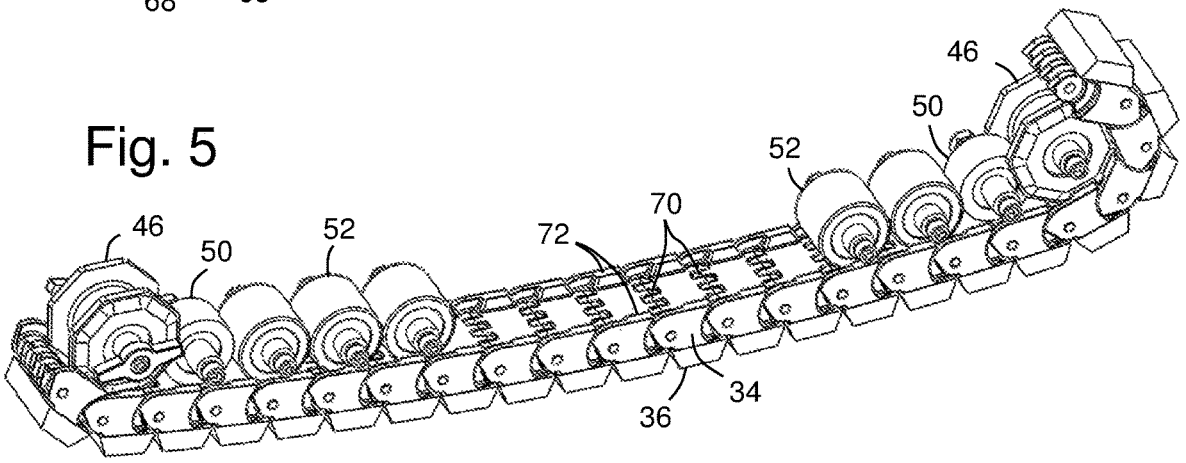
FIG. 5 shows a perspective view of a segment of track and rollers, with some rollers removed to show the internal rolling surface of the track.

FIG. 5 shows the bottom section of track and rollers, with several mid-rollers removed to expose the interdigitated rolling surface 70 of link-bodies 34. The rollers and link bodies are preferably made of a hard and resilient (low-damping) material. Hardness helps reduce the strain energy associated with the deflection of the rollers and links, and resilience helps recycle more of the energy as the roller/track contact moves along. A steel train wheel on a steel track has exceptionally low rolling friction for this reason. For an off-road skate, however, the intended ground surface is not smooth and could include hard-packed dirt and gravel. If there were no compliance in the system, the result would be a jarring ride with high rolling resistance due to impacts and the pressing of small rocks into dirt.

A typical solution is to use the tracks only on soft ground, or to add suspension or a soft tread to the rollers. The preferred solution described herein is to add compliance to the outside of the track. This is the reason for treads 36 attached to the link-bodies 34. To understand the advantage, consider terrain with hard-packed dirt and a single small pebble. Using compliant rollers, each roller deflects as the track goes over the pebble, and energy is absorbed (and partially returned) many times. With compliance on the outside of the track, the tread in contact with the pebble sees only one compression/extension cycle. This translates to less energy loss and lower rolling friction.

The preferred material for the rollers and link bodies is a hard, resilient, high-strength, low-friction, high-wear polymer such as Delrin, Nylon, or one of the hardest grades of urethane. Many other polymers would also be acceptable, and various fillers such as glass-fiber, carbon fiber, PTFE, graphite and moly-disulphide may be beneficial to increase strength or improve lubricity. Using polymers, the initial (low-strain) Young's modulus is preferably greater than 20 ksi, to avoid excessive deflection, and less than 600 ksi to avoid excessive contact stress. If 3D printed, Nylon alloy 910 is a good choice. The rollers and link bodies need not be made of the same material, and it is acceptable to use ball bearings rolling directly on the link bodies. Methods of fabricating the link-bodies and rollers include injection molding, 3D printing, machining and casting.

While polymers are preferred to minimize cost, there may be a performance benefit in strength/weight ratio and rolling resistance to using metal links and/or rollers. Fabrication methods include machining, metal injection molding, casting and 3D printing.

For the skate application, treads 36 in FIG. 5 are preferably made of a tear resistant, high friction, abrasion resistant, resilient elastomeric material with durometer between 40 and 90 Shore A. Example tread materials include EVA, EVA/SBR blend and polyurethane closed-cell foam. Solid rubber is acceptable, but for lightest weight and best ride quality, a closed-cell foam is preferred. For greater durability, the treads may have a foam or porous interior and a solid external skin. This can be achieved by molding, 3D printing, or by bonding a thin (e.g. 1/16 inch) sheet of solid rubber over a closed-cell foam. The thin sheet of solid rubber may also be fabric-reinforced for greater tear resistance. Example methods to join the treads to the link bodies include overmolding, bonding, 3D printing, or various mechanical features such as dovetails, cross-pins, snaps and industrial Velcro products.

The rollers and link bodies have mating male and female features configured to resist side loads on the track, while minimizing friction. Example features are a raised ridge on the rollers engaging a groove in the track, or a raised ridge on the links engaging a groove in the rollers. The preferred method, as shown in FIG. 5, is for mid-rollers 52 to fit closely within flanges 72 of link-bodies 34. This allows sidewalls 60 of skate frame 24 (FIG. 4) to shield the link bodies from dirt, while still allowing rollers 52 to be lower than sidewalls 60. This is an important safety feature. In the event that the track breaks, it is desirable for the skate to bottom out on the rollers and not on sidewalls 60 as the latter may cause the skate to stop abruptly and the rider to pitch forward and fall.

Figure 6:
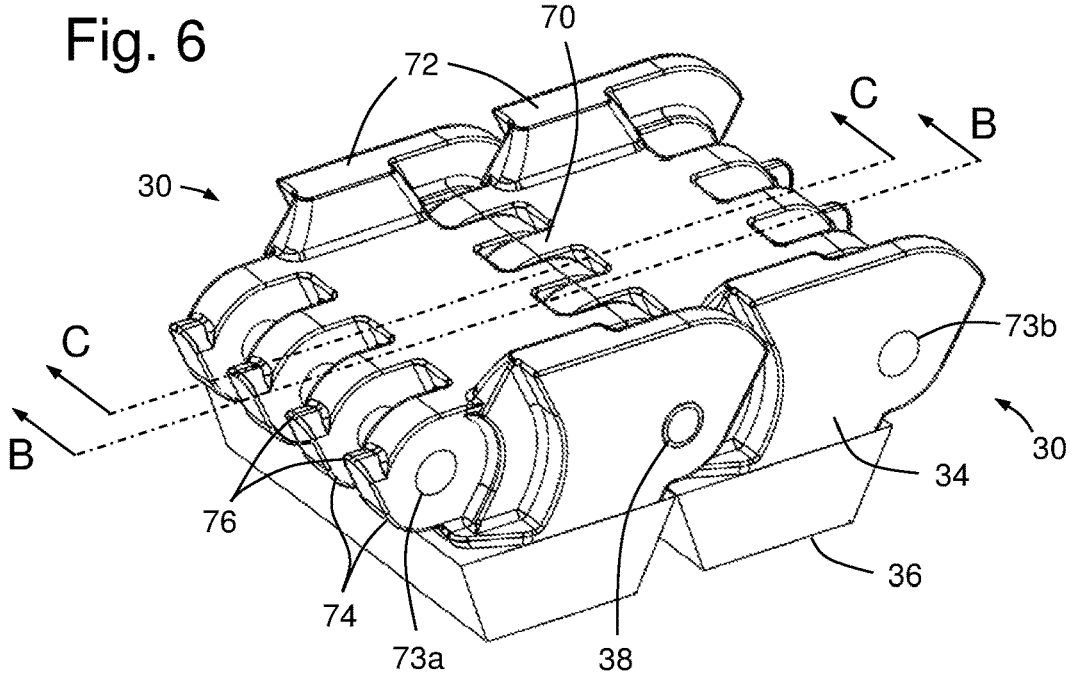
FIG. 6 shows a perspective view of two hinged links of a track.

As shown in FIG. 5, interdigitated hinges 70 provide a smooth transition as mid-rollers 50 and 52 roll from one link-body 34 to the next. FIG. 6 provides further detail. Two links 30 are shown, each having hinge knuckles 74 on both ends. The hinge knuckles of one link fit into the gaps between knuckles of the mating link and are pinned crosswise by hinge pin 38, forming interdigitated hinge 70. The pins may be hollow to save weight. They are preferably made of a wear and corrosion-resistant material such as hardened stainless steel or hard-coat anodized aluminum. The pins can be retained by making the holes smaller in the knuckles on one end of the link than on the other. For instance, holes 73*a* can be smaller than holes 73*b*, so that when the track is assembled, hinge pins 38 are press-fit into holes 73*a*, but slip-fit relative to holes 73*b*. Alternate methods to retain the hinge pins include bonding, swaging, riveting, screws, and retaining rings.

When traversing an obstacle such as a root or rock, it is desirable to prevent the hinges from deflecting inward (reverse bending), since this forms a kink in the track that the rollers must roll over and results in high rolling resistance. The normal approach is to use an external hinge-stop as per Miller or Freilich, however, this results in a pinching action as the track comes around the front end-roller and flattens out. If a small rock or sand gets pinched, it is likely to damage the hinge-stop, as well as causing very high loads on the hinge pin and knuckles.

Figure 7:
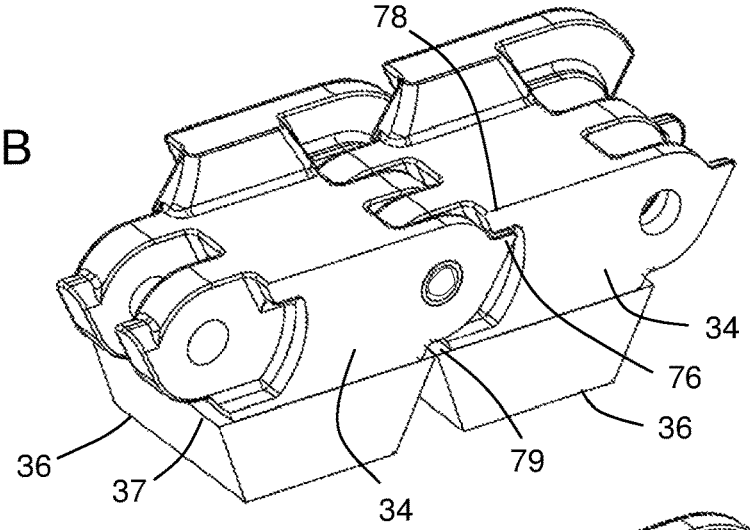
FIG. 7 shows a cut-away perspective view (section B-B of FIG. 6) of two hinged links of a track.
Figure 8:
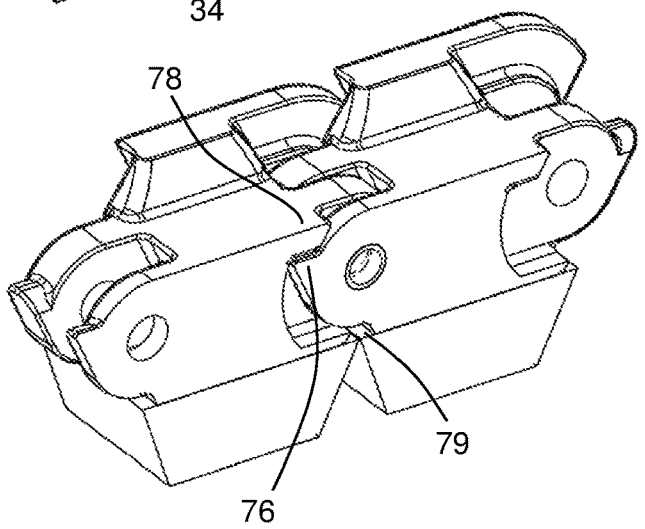
FIG. 8 shows a second cut-away perspective view (Section C-C of FIG. 6) of two hinged links of a track.

The preferred solution, as shown in FIGS. 6-8 is to use internal hinge stops. Hinge knuckles 74 have bumps 76 which engage webs 78 between adjacent knuckles. These features are protected from dirt and debris, and they efficiently transfer load from the rollers to the ground while minimizing stress on the hinge knuckles and hinge pin.

Note that the bumps on the knuckles of one link engage the webs between the knuckles of the adjacent link and visa-versa. This hand-shaking effect doubles the strength of the hinge stops. Also important is that the knuckles are closely interdigitated and the webs can be supported on three sides. This maximizes strength, and is an enabling feature for allowing the link-bodies to be made of plastic. For best results, the links should have at least three knuckles on each end. Use of four knuckles on one end and five on the other is especially preferred.

In FIG. 7, gap 79 between link-bodies 34 avoids a potential pinch-point. Without the gap, the contacting surfaces would be prone to jamming with ground debris and causing a kink in the track as the links make the transition from the front recirculating portion to the bottom load-bearing portion. A kink in the track leads to excessive stress on the hinge which can cause stretching or breakage of the track.

While pinch-points between link-bodies are to be avoided, small pinch-points between treads are acceptable as long as they allow the bottom portion of the track, under load, to assume the normal curvature defined by the mid-rollers. For instance, edges 37 of treads 36 may overhang the bottom surfaces of the link-bodies. This results in a very small pinch point between treads which is beneficial to form a seal and reduce mud infiltration of the hinges. However, if debris gets pinched, the treads deflect enough to avoid a kink in the track that would overstress the hinge.

Figure 9:
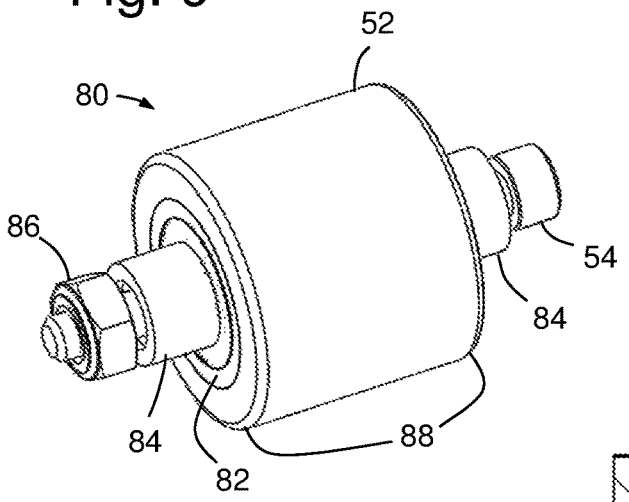
FIG. 9 shows a perspective view of a mid-roller assembly.
Figure 10:
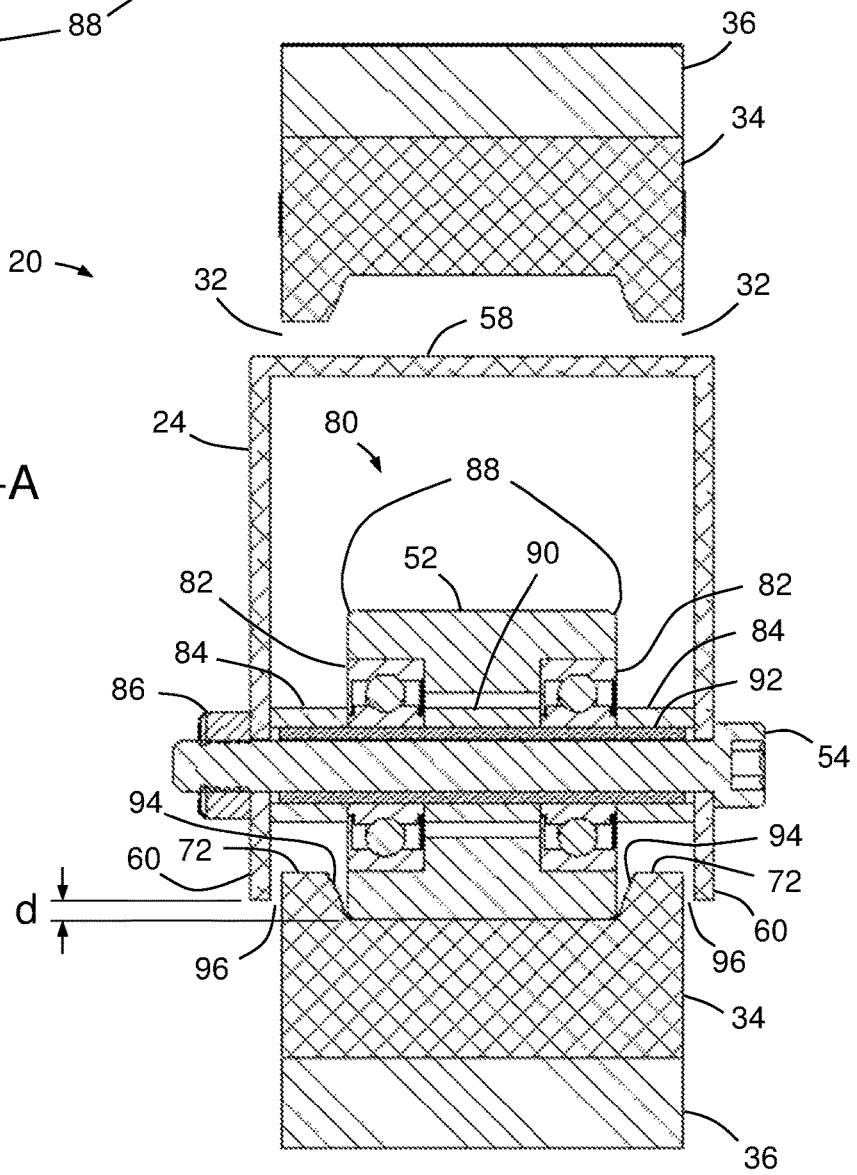
FIG. 10 shows a simplified cross-section (Section A-A of FIG. 1) of a tracked skate runner.

FIGS. 9 and 10 provide additional detail regarding the mid-rollers 52, their attachment to skate frame 24, and the method of keeping out and cleaning out dirt. Mid-roller assembly 80 includes roller 52 and ball-bearings 82 pressed in on either end. The roller may have chamfered or rounded edges 88. Bearing spacers 84 center the roller, and roller attachment screw 54 and locknut 86 attach the roller assembly to the skate frame 24 using holes 64, FIG. 4.

FIG. 10 is cross-section A-A, FIG. 1 of skate track runner 20 showing just the parts that are sectioned. In this view, additional parts of mid-roller assembly 80 are visible. Center bearing spacer 90 mounts between the ball-bearings, and axle tube 92 is mounts internally to the bearings and spacers. Mid-roller 52 fits closely between flanges 72 of link-body 34. For lowest rolling resistance it is desirable for the track to be slightly slack. This can allow a small separation between the rollers and the links when the skate is off the ground. To insure that the links re-engage the rollers properly, one or both of the mating may have rounded or chamfered edges. In this example, the rollers 52 have rounded edges 88 and the link bodies 34 have rounded/chamfered edges 94 of flanges 72.

To prevent dirt intrusion from either side of the track, sidewalls 60 of skate frame 24 fit closely with link body 34. In this example, the sidewalls sandwich the link-body, extending over flanges 72 of link bodies 34 leaving small gaps 96. The mid-rollers 52 extend a small distance "d" below the sidewalls, preferably about 1/16 inch. In the event of the track breaking, the roller assembly will continue to roll forward leaving the track behind, and the rollers will touch down before the sidewalls. This reduces the likelihood that the rider will fall forward.

Some dirt may tend to stick to the sides of the links, especially if the ground is wet. As the track recirculates, the dirt will tend to fall downward and land on top dirt shield 58. Gaps 32 between the recirculating track and the dirt shield provide a "dirt window", allowing the dirt to slide off to the sides. A slanted, tent-like or domed dirt shield may be used, but is not essential because the normal skating motion tends to bank the skate. Vertical vibration of the recirculating track also produces air currents which expel dirt. Any dirt that gets into the interior of the roller assembly will tend to deposit in the channel between the flanges 72 of link bodies 34. When the track recirculates, the links turn upside-down and the dirt falls on the dirt shield and migrates out the dirt windows. In this way, the skate track runner is self-cleaning.

FIGS. 11-14 provide additional detail on the rollers near the front and rear of the roller assembly, i.e. end-rollers 46 and the end-most mid-rollers 50, FIG. 5. In a preferred embodiment, these rollers overlap in order to shorten the span between them and reduce the bending load on the hinge-stops. To maintain alignment of the track as it recirculates, it is preferable for the end-rollers to fit closely within the flanges 72 of link-bodies 34, FIG. 5, while the end-most mid-rollers 50 can be narrower, and fit between the flanges 112 FIG. 13, of the end-rollers.

In FIG. 11, the end-most mid-roller assembly 100 shows end-most mid-roller 50 with ball bearings 82 pressed in, and bearing spacers 102 providing lateral alignment. Roller attachment screw 54 and locknut 86 secure the roller assembly to skate frame 24, FIG. 4, using holes 65. In FIG. 12, end-most mid-roller 50 has chamfered lip 104 which allows bearings 82 to be pressed in and retained by snap-action. Axle tube 92 inserts through the bearings 82 and bearing spacer 102. This forms an assembly that mounts to skate frame 24, FIG. 4 by attachment screw 54 and locknut 86.

Figure 13:
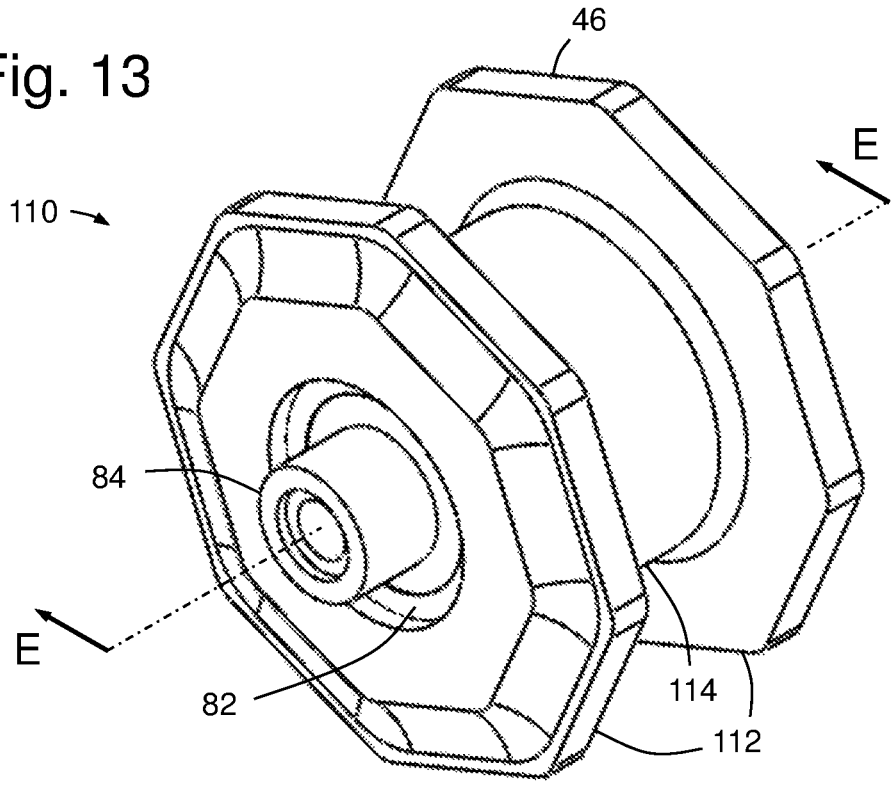
FIG. 13 shows a perspective view of an end-roller unit.
Figure 14:
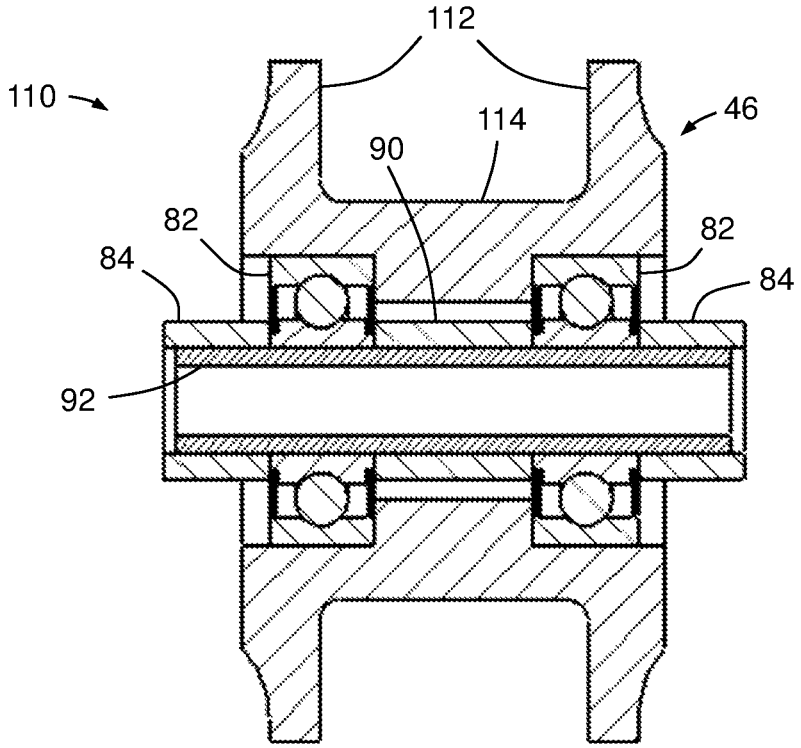
FIG. 14 shows cross-section E-E of FIG. 13.

FIGS. 13 and 14 show a perspective and a cross-sectional view of end-roller assembly 110. End-roller 46 is spool-shaped, with flanges 112 and mid-section 114. Bearings 82 are pressed in from either end and spaced apart by center bearing spacer 90. Axle tube 92 inserts through the bearings and center bearing spacer, as well as end bearing spacers 84.

The variations of the invention described above have certain desirable and surprising combinations. For instance, the use of flanged links enables the rollers to be mounted lower than the sidewalls (for safety), while still shielding out dirt, and it allows the use of spool-shaped end-rollers that overlap the adjacent narrower mid-rollers to better support the track.

Using plastic links, strength is a key concern. Having the rollers roll over the interdigitated knuckles of the links not only maximizes the amount of material available to make the hinge, but enables a hand-shaking hinge-stop devoid of external pinch-points that can get jammed with ground debris.

Hard rollers rolling on hard link-bodies provide very low rolling resistance but increase sensitivity to fouling, so the combination with sidewalls and a self-cleaning top-dirt shield is key. With hard rolling elements, the addition of soft treads to the links is important to maintain ride quality as well as to protect the link-bodies from damage from rocks and gravel. Adding the treads increases the risk of pinching debris, but this is mitigated by chamfering the treads.

For the skate application, there is a sweet spot of rocker, link width, tread thickness, track pitch, and end-roller link angles. Getting this combination right has eluded the prior art and is a major factor in the lack of commercial success of a tracked skate.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

The invention claimed is:

1. A tracked skate runner comprising an elongate roller assembly and an endless track of hinged links wherein:

a. the track has a bottom load-bearing portion, a top recirculating portion, a front turnaround portion and a rear turnaround portion, b. the roller assembly includes a skate frame supporting a plurality of mid-rollers configured to bear against the bottom portion of the track, and end-rollers configured to engage the front portion and rear portion of the track, c. the mid-rollers have outer rolling surfaces, d. the links have inner rolling surfaces configured to engage the outer rolling surfaces of the mid-rollers, e. the skate frame provides a channel having sidewalls and a top dirt shield, f. the sidewalls fit closely with the links of the bottom portion of the track to shield the mid-rollers from dirt, g. the top dirt shield is located between the mid-rollers and the top recirculating portion of the track, and is configured to shed dirt away from the rolling surfaces of the mid-rollers, and, h. the links are configured to avoid jamming of ground debris between adjacent links as the links make the transition from the front recirculating portion to the bottom load-bearing portion, preventing kinking of the bottom load-bearing portion of the track.

2. The tracked skate runner of claim 1 wherein the channel defined by the skate frame is machined from an aluminum extrusion, or bent from sheet metal.

3. The tracked skate runner of claim 1 wherein the links have flanges forming a guide channel for the rollers, and the sidewalls of the skate frame overlap the flanges.

4. The tracked skate runner of claim 3 wherein at least one of the end-rollers is spool-shaped and overlaps the adjacent mid-roller.

5. The tracked skate runner of claim 4 wherein:

a. the links have a plurality of knuckles on both ends, b. the knuckles of adjacent links mate together and are pinned crosswise to form hinges such that the inner rolling surfaces of the links provide an interdigitated rolling surface for the rollers, c. the knuckles have bumps, d. the links have webs between the knuckles, and, e. the bumps of a first link engage the webs of a second link, and the bumps of the second link engage the webs of the first link when the included angle between the two links is approximately 180°.

6. The tracked skate runner of claim 5 wherein:

a. materials forming the inner rolling surfaces of the links and the outer rolling surfaces of the mid-rollers have initial Young's modulus of at least 20 ksi, b. the links have treads opposite the inner rolling surfaces, and the treads include rubber or foam with durometer in the range 40 to 90 Shore A, and c. the treads are chamfered or rounded such that the included angle between the treads of adjacent links on the bottom portion of the track is 30° or greater.

7. The tracked skate runner of claim 4 wherein:

a. materials forming the inner rolling surfaces of the links and the outer rolling surfaces of the mid-rollers have initial Young's moduli of at least 20 ksi, b. the links have treads opposite the inner rolling surfaces, and the treads include rubber or foam with durometer in the range 40 to 90 Shore A, and c. the treads are chamfered or rounded such that the included angle between the treads of adjacent links on the bottom portion of the track is 30° or greater.

8. The tracked skate runner of claim 7 wherein:

a. the skate frame includes brackets for attachment to a skate boot or foot platform, b. the bottom portion of the track has rocker between 0.15 and 0.6 inches, c. the links engaging the end-rollers form an included angle between 120 and 144°, d. the pitch of the track is between 0.5 and 1.2 inches, e. the width of the links is between 0.7 and 2 inches, and f. the thickness of the treads is between 0.1 and 0.5 inches.

9. The tracked skate runner of claim 4 wherein:

a. the skate frame includes brackets for attachment to a skate boot or foot platform, b. the bottom portion of the track has rocker between 0.15 and 0.6 inches, c. the links engaging the end-rollers form an included angle between 120 and 144°, d. the pitch of the track is between 0.5 and 1.2 inches, and e. the width of the links is between 0.7 and 2 inches.

10. The tracked skate runner of claim 1 wherein the links have a plurality of knuckles on both ends, and the knuckles of adjacent links mate together and are pinned crosswise to form hinges such that the inner rolling surfaces of the links provide an interdigitated rolling surface for the mid-rollers.

11. The tracked skate runner of claim 10 wherein the links include internal hinge-stops to resist reverse bending.

12. The tracked skate runner of claim 11 wherein:

a. the knuckles have bumps b. links have webs between knuckles, and, c. the bumps of a first link engage webs of a second link, and the bumps of the second link engage webs of the first link when the included angle between the first and second links is approximately 180°.

13. The tracked skate runner of claim 12 wherein:

a. materials forming the inner rolling surfaces of the links and the outer rolling surfaces of the mid-rollers have initial Young's modulus of at least 20 ksi, b. the links have treads opposite the inner rolling surfaces, and the treads include rubber or foam with durometer in the range 40 to 90 Shore A, and c. the treads are chamfered or rounded such that the included angle between the treads of adjacent links on the bottom portion of the track is 30° or greater.

14. The tracked skate runner of claim 13 wherein:

a. the skate frame includes brackets for attachment to a skate boot or foot platform, b. the bottom portion of the track has rocker between 0.15 and 0.6 inches, c. the links engaging the end-rollers form an included angle between 120 and 144°, d. the pitch of the track is between 0.5 and 1.2 inches, e. the width of the links is between 0.7 and 2 inches, and
f. the thickness of the treads is between 0.1 and 0.5 inches.

15. The tracked skate runner of claim 12 wherein:
a. the skate frame includes brackets for attachment to a skate boot or foot platform,
b. the bottom portion of the track has rocker between 0.15 and 0.6 inches,
c. the links engaging the end-rollers form an included angle between 120 and 144°,
d. the pitch of the track is between 0.5 and 1.2 inches, and
e. the width of the links is between 0.7 and 2 inches.

16. The tracked skate runner of claim 1 wherein the materials of the inner rolling surfaces of the links and the outer rolling surfaces of the mid-rollers have initial Young's moduli of at least 20 ksi.

17. The tracked skate runner of claim 16 wherein the links have treads opposite the inner rolling surfaces, and the treads include rubber or foam with durometer in the range 40 to 90 Shore A.

18. The tracked skate runner of claim 17 wherein the treads are chamfered or rounded such that the included angle between treads of adjacent links on the bottom portion of the track is 30° or greater.

19. The tracked skate runner of claim 18 wherein:
a. the skate frame includes brackets for attachment to a skate boot or foot platform,
b. the bottom portion of the track has rocker between 0.15 and 0.6 inches,
c. the links engaging the end-rollers form an included angle between 120 and 144°,
d. the pitch of the track is between 0.5 and 1.2 inches,
e. the width of the links is between 0.7 and 2 inches, and
f. the thickness of the treads is between 0.1 and 0.5 inches.

20. The tracked skate runner of claim 1 wherein,
a. the skate frame includes brackets for attachment to a skate boot or foot platform,
b. the bottom portion of the track has rocker between 0.15 and 0.6 inches,
c. the links engaging the end-rollers form an included angle between 120 and 144°,
d. the pitch of the track is between 0.5 and 1.2 inches, and
e. the width of the links is between 0.7 and 2 inches.

21. The tracked skate runner of claim 1 further comprising a gap between the top recirculating portion of the track and the dirt shield.

22. A tracked skate runner comprising:
an endless track of hinged links having inner rolling surfaces, the endless track having a bottom load-bearing portion, a top recirculating portion, a front turnaround portion and a rear turnaround portion,
a skate frame having a top dirt shield and sidewalls joined to the dirt shield to provide a downward facing channel, the top dirt shield being disposed between the mid-rollers and the top recirculating portion of the track, and,
within the channel, a roller assembly comprising (a) a plurality of mid-rollers having outer rolling surfaces configured to bear against the bottom portion of the track and engage the inner rolling surfaces, and (b) end-rollers configured to engage the front portion and rear portion of the track,
wherein the skate frame prevents fouling of the mid-rollers with dirt.

23. The tracked skate runner of claim 22 wherein the links have flanges forming a guide channel for the rollers, and the sidewalls of the skate frame overlap the flanges.

24. The tracked skate runner of claim 22 wherein at least one of the end-rollers is spool-shaped and overlaps the adjacent mid-roller.

25. The tracked skate runner of claim 22 wherein the links have a plurality of knuckles on both ends, and the knuckles of adjacent links mate together and are pinned crosswise to form hinges such that the inner rolling surfaces of the links provide an interdigitated rolling surface for the mid-rollers.

26. The tracked skate runner of claim 22 wherein the links include internal hinge-stops to resist reverse bending.

27. The tracked skate runner of claim 22 wherein the treads are chamfered or rounded such that the included angle between treads of adjacent links on the bottom portion of the track is 30° or greater.

* * * * *